US010087400B2

(12) United States Patent
Klug et al.

(10) Patent No.: US 10,087,400 B2
(45) Date of Patent: Oct. 2, 2018

(54) STORAGE-STABLE COMPOSITIONS COMPRISING SOIL RELEASE POLYMERS

(71) Applicant: Clariant International Ltd., Muttenz (CH)

(72) Inventors: Peter Klug, Grossostheim (DE); Peter Naumann, Taunusstein (DE); Carsten Cohrs, Frankfurt (DE); Henricus Peerlings, Spabrücken (DE)

(73) Assignee: Clariant International Ltd., Muttenz (CH)

( * ) Notice: Subject to any disclaimer, the term of this patent is extended or adjusted under 35 U.S.C. 154(b) by 0 days.

(21) Appl. No.: 15/324,143

(22) PCT Filed: Jul. 6, 2015

(86) PCT No.: PCT/EP2015/065389

§ 371 (c)(1),
(2) Date: Jan. 5, 2017

(87) PCT Pub. No.: WO2016/005338

PCT Pub. Date: Jan. 14, 2016

(65) Prior Publication Data

US 2017/0145348 A1 May 25, 2017

(30) Foreign Application Priority Data

Jul. 9, 2014 (EP) ..... 14002349

(51) Int. Cl.

| | |
|---|---|
| ***C11D 3/20*** | (2006.01) |
| ***C11D 3/00*** | (2006.01) |
| ***C11D 3/37*** | (2006.01) |
| ***C11D 11/00*** | (2006.01) |

(52) U.S. Cl.

CPC ..... *C11D 3/0036* (2013.01); *C11D 3/2044* (2013.01); *C11D 3/2068* (2013.01); *C11D 3/3715* (2013.01); *C11D 11/0017* (2013.01)

(58) Field of Classification Search

CPC ..... C11D 3/20; C11D 3/2041; C11D 3/3715
See application file for complete search history.

(56) References Cited

U.S. PATENT DOCUMENTS

| | | | |
|---|---|---|---|
| 4,759,876 | A | 7/1988 | Crossin |
| 6,153,723 | A | 11/2000 | Lang et al. |
| 9,365,806 | B2 | 6/2016 | Carswell et al. |
| 2009/0036641 | A1 | 2/2009 | Lang et al. |
| 2010/0098655 | A1 | 4/2010 | Lang et al. |
| 2011/0095109 | A1 | 4/2011 | Borchers et al. |
| 2011/0098418 | A1 | 4/2011 | Morschhaeuser et al. |
| 2015/0166938 | A1 | 6/2015 | Fischer et al. |
| 2015/0203630 | A1 | 7/2015 | Fischer et al. |
| 2015/0218491 | A1 | 8/2015 | Morschhaeuser et al. |
| 2015/0240029 | A1 | 8/2015 | Fischer et al. |
| 2017/0321154 | A1 | 11/2017 | Cohrs et al. |
| 2017/0327773 | A1 | 11/2017 | Cohrs et al. |

FOREIGN PATENT DOCUMENTS

| | | | | |
|---|---|---|---|---|
| DE | 102007005532 | | 8/2008 | |
| DE | 102007013217 | | 9/2008 | |
| EP | 0964015 | | 12/1999 | |
| EP | 1661933 | | 5/2006 | |
| WO | WO 2007079850 | | 7/2007 | |
| WO | WO 2014/019658 | * | 2/2014 | ..... C08G 63/183 |

OTHER PUBLICATIONS

International Search Report for PCT/EP2015/065389 dated Dec. 1, 2015.
International Preliminary Report on Patentability for PCT/EP2015/065389 dated Jan. 10, 2017.
Machine translation of EP 1661933, dated May 31, 2006.
Machine translation of DE 102007013217, dated Sep. 18, 2008.

* cited by examiner

*Primary Examiner* — Brian P Mruk
(74) *Attorney, Agent, or Firm* — Tod A. Waldrop

(57) ABSTRACT

Compositions are described comprising
A) of from 45 to 55% by weight of one or more polyesters according to the following formula (I)

(I)

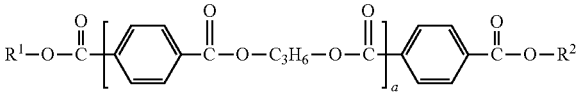

wherein
$R^1$ and $R^2$ independently of one another are X—$(OC_2H_4)_n$—$(OC_3H_6)_m$ wherein X is $C_{1-4}$ alkyl, the —$(OC_2H_4)$ groups and the —$(OC_3H_6)$ groups are arranged blockwise and the block consisting of the —$(OC_3H_6)$ groups is bound to a COO group or are HO—$(C_3H_6)$,
n is based on a molar average a number of from 12 to 120,
m is based on a molar average a number of from 1 to 10, and
a is based on a molar average a number of from 4 to 9 and
B) of from 10 to 30% by weight of one or more alcohols selected from the group consisting of ethylene glycol, 1,2-propylene glycol, 1,3-propylene glycol, 1,2-butylene glycol, 1,3-butylene glycol, 1,4-butylene glycol and butyl glycol and
C) of from 24 to 42% by weight of water,
the amounts in each case being based on the total weight of the composition.
The compositions may advantageously be used in laundry detergent and fabric care products.

23 Claims, No Drawings

STORAGE-STABLE COMPOSITIONS COMPRISING SOIL RELEASE POLYMERS

The invention relates to compositions comprising polyesters. The polyesters are e.g. useful as soil release agents and the inventive compositions may be used in laundry detergent and fabric care products.

The term "soil release agent" is applied to materials that modify the fabric surface minimizing the subsequent soiling and making the cleaning of the fabric easier on further washing cycles.

Laundry detergent compositions containing polyesters have been widely disclosed in the art.

DE 10 2007 013 217 A1 and WO 2007/079850 A1 disclose anionic polyesters that may be used as soil release components in washing and cleaning compositions.

DE 10 2007 005 532 A1 describes aqueous formulations of soil release oligo- and polyesters with a low viscosity. The aqueous formulations may e.g. be used in washing and cleaning compositions.

EP 0 964 015 A1 discloses soil release oligoesters that may be used as soil release polymers in detergents and that are prepared using polyols comprising 3 to 6 hydroxyl groups.

EP 1 661 933 A1 is directed to at room temperature flowable, amphiphilic and nonionic oligoesters prepared by reacting dicarboxylic acid compounds, polyol compounds and water-soluble alkylene oxide adducts and their use as additive in washing and cleaning compositions.

However, many of the polyesters described in the prior art are in need of improved stability in an alkaline environment. Especially in alkaline heavy duty washing liquids polyesters often show turbidity upon incorporation and by alkaline hydrolysis thereby also losing soil release power.

The polyesters described in WO 2013/019658 A1 fulfill these requirements and possess an advantageous, increased stability against hydrolysis and an excellent soil-release-effect, but they are solids that melt at approximately 50° C. and therefore, their handling is not easy in practice due to the necessity of hot storage and handling.

Therefore, it was the object of the present invention to provide compositions of these polyesters that can be handled easily in practice and that are liquid and storage-stable.

Surprisingly this object is solved by compositions comprising

A) of from 45 to 55% by weight of one or more polyesters according to the following formula (I)

(I)

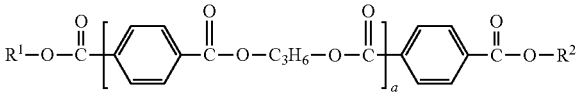

wherein $R^1$ and $R^2$ independently of one another are $X—(OC_2H_4)_n—(OC_3H_6)_m$ wherein X is $C_{1-4}$ alkyl and preferably methyl, the $—(OC_2H_4)$ groups and the $—(OC_3H_6)$ groups are arranged blockwise and the block consisting of the $—(OC_3H_6)$ groups is bound to a COO group or are $HO—(C_3H_6)$, and preferably are independently of one another $X—(OC_2H_4)_n—(OC_3H_6)_m$, n is based on a molar average a number of from 12 to 120 and preferably of from 40 to 50, m is based on a molar average a number of from 1 to 10 and preferably of from 1 to 7, and a is based on a molar average a number of from 4 to 9 and B) of from 10 to 30% by weight of one or more alcohols selected from the group consisting of ethylene glycol, 1,2-propylene glycol, 1,3-propylene glycol, 1,2-butylene glycol, 1,3-butylene glycol, 1,4-butylene glycol and butyl glycol and C) of from 24 to 42% by weight of water, the amounts in each case being based on the total weight of the composition.

Therefore, a subject matter of the present invention are compositions comprising A) of from 45 to 55% by weight of one or more polyesters according to the following formula (I)

(I)

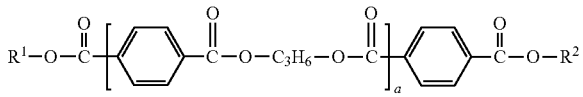

wherein $R^1$ and $R^2$ independently of one another are $X—(OC_2H_4)_n—(OC_3H_6)_m$ wherein X is $C_{1-4}$ alkyl and preferably methyl, the $—(OC_2H_4)$ groups and the $—(OC_3H_6)$ groups are arranged blockwise and the block consisting of the $—(OC_3H_6)$ groups is bound to a COO group or are $HO—(C_3H_6)$, and preferably are independently of one another $X—(OC_2H_4)_n—(OC_3H_6)_m$, n is based on a molar average a number of from 12 to 120 and preferably of from 40 to 50, m is based on a molar average a number of from 1 to 10 and preferably of from 1 to 7, and a is based on a molar average a number of from 4 to 9 and B) of from 10 to 30% by weight of one or more alcohols selected from the group consisting of ethylene glycol, 1,2-propylene glycol, 1,3-propylene glycol, 1,2-butylene glycol, 1,3-butylene glycol, 1,4-butylene glycol and butyl glycol and C) of from 24 to 42% by weight of water, the amounts in each case being based on the total weight of the composition.

Butyl glycol has the following structure: $CH_3(CH_2)_3OCH_2CH_2OH$.

It is an advantage of the inventive compositions that they are based on water and on solvents that are not easily flammable.

Aqueous or aqueous-alcoholic solutions of the polyesters often possess a relatively good stability when stored at 5° C. However, when stored at 25° C. for a longer period of time and even faster at elevated temperatures of from 30 to 50° C., that may occur during transport or storage, non-inventive compositions of the polyesters at first show a turbidity during storage that later results in massive precipitations. These precipitations cannot be dissolved again at 80° C., meaning that the respective products may not be regarded as being storage-stable, and their properties are changed irreversibly by storage at elevated temperature.

The inventive compositions furthermore possess the advantage that they are sufficiently storage-stable, also at elevated temperatures.

The inventive compositions preferably are solutions at 25° C.

In the polyesters of component A) of the inventive compositions according to formula (I) group "X" is $C_{1-4}$ alkyl and preferably is methyl.

In a preferred embodiment of the invention the one or more polyesters of component A) of the inventive compositions are according to the following formula (I)

(I)

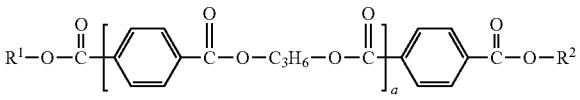

wherein $R^1$ and $R^2$ independently of one another are $H_3C—(OC_2H_4)_n—(OC_3H_6)_m$ wherein the $—(OC_2H_4)$ groups and the $—(OC_3H_6)$ groups are arranged blockwise and the block consisting of the $—(OC_3H_6)$ groups is bound to a COO group or are $HO—(C_3H_6)$, and preferably are independently of one another $H_3C—(OC_2H_4)_n—(OC_3H_6)_m$, n is based on a molar average a number of from 40 to 50, m is based on a molar average a number of from 1 to 7, and a is based on a molar average a number of from 4 to 9.

In the one or more polyesters of component A) of the inventive compositions according to formula (I) variable "a" based on a molar average preferably is a number of from 5 to 8 and more preferably is a number of from 6 to 7.

In the one or more polyesters of component A) of the inventive compositions according to formula (I) variable "m" based on a molar average preferably is a number of from 2 to 5.

In the one or more polyesters of component A) of the inventive compositions according to formula (I) variable "n" based on a molar average preferably is a number of from 43 to 47, more preferably is a number of from 44 to 46 and even more preferably is 45.

In one particularly preferred embodiment of the invention the one or more polyesters of component A) of the inventive compositions are according to the following formula (I)

(I)

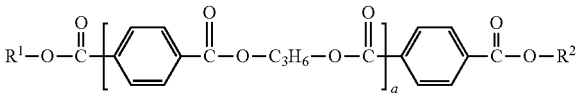

wherein $R^1$ and $R^2$ independently of one another are $H_3C—(OC_2H_4)_n—(OC_3H_6)$, wherein the $—(OC_2H_4)$ groups and the $—(OC_3H_6)$ groups are arranged blockwise and the block consisting of the $—(OC_3H_6)$ groups is bound to a COO group, n is based on a molar average a number of from 44 to 46, m is based on a molar average 2, and a is based on a molar average a number of from 5 to 8.

Among these one or more polyesters the polyesters according to formula (I)

(I)

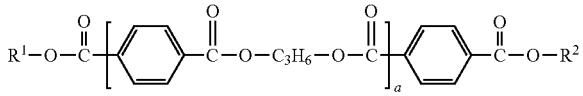

wherein $R^1$ and $R^2$ independently of one another are $H_3C—(OC_2H_4)_n—(OC_3H_6)_m$ wherein the $—(OC_2H_4)$ groups and the $—(OC_3H_6)$ groups are arranged blockwise and the block consisting of the $—(OC_3H_6)$ groups is bound to a COO group, n is based on a molar average 45, m is based on a molar average 2, and a is based on a molar average a number of from 6 to 7 are especially preferred.

In another particularly preferred embodiment of the invention the one or more polyesters of component A) of the inventive compositions are according to the following formula (I)

(I)

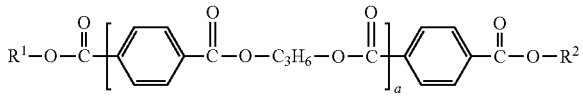

wherein $R^1$ and $R^2$ independently of one another are $H_3C—(OC_2H_4)_n—(OC_3H_6)$, wherein the $—(OC_2H_4)$ groups and the $—(OC_3H_6)$ groups are arranged blockwise and the block consisting of the $—(OC_3H_6)$ groups is bound to a COO group, n is based on a molar average a number of from 44 to 46, m is based on a molar average 5, and a is based on a molar average a number of from 5 to 8.

Among these one or more polyesters the polyesters according to formula (I)

(I)

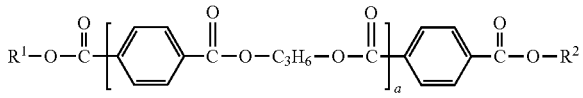

wherein $R^1$ and $R^2$ independently of one another are $H_3C—(OC_2H_4)_n—(OC_3H_6)_m$ wherein the $—(OC_2H_4)$ groups and the $—(OC_3H_6)$ groups are arranged blockwise and the block consisting of the $—(OC_3H_6)$ groups is bound to a COO group, n is based on a molar average 45, m is based on a molar average 5, and a is based on a molar average a number of from 6 to 7 are especially preferred.

The groups $—O—C_2H_4—$ in the structural units "$X—(OC_2H_4)_n—(OC_3H_6)_m$" or "$H_3C—(OC_2H_4)_n—(OC_3H_6)_m$" are of the formula $—O—CH_2—CH_2—$.

The groups $—O—C_3H_6—$ in the structural units indexed with "a", in the structural units "$X—(OC_2H_4)_n—(OC_3H_6)_m$" or "$H_3C—(OC_2H_4)_n—(OC_3H_6)$," and in the structural units HO—$(C_3H_6)$ are of the formula —O—$CH(CH_3)$—$CH_2$— or —O—$CH_2$—$CH(CH_3)$—, i.e. are of the formula

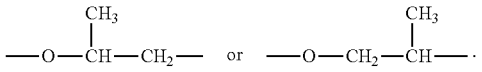

The inventive compositions may advantageously be used in laundry detergent and fabric care products and in particular in liquid laundry detergent and fabric care products. Besides the inventive compositions these laundry detergent and fabric care products may comprise one or more optional ingredients, e.g. they may comprise conventional ingredients commonly used in laundry detergent and fabric care products. Examples of optional ingredients include, but are not limited to builders, surfactants, bleaching agents, bleach active compounds, bleach activators, bleach catalysts, photobleaches, dye transfer inhibitors, color protection agents, anti-redeposition agents, dispersing agents, fabric softening and antistatic agents, fluorescent whitening agents, enzymes, enzyme stabilizing agents, foam regulators, defoamers, malodour reducers, preservatives, disinfecting agents, hydrotopes, fibre lubricants, anti-shrinkage agents, buffers, fragrances, processing aids, colorants, dyes, pigments, anticorrosion agents, fillers, stabilizers and other conventional ingredients for laundry detergent and fabric care products.

The inventive compositions have an advantageous stability in alkaline environment, possess a beneficial solubility and advantageously are clearly soluble in alkaline compositions such as heavy duty washing liquids and also possess advantageous soil release properties. In laundry detergent or fabric care products they result in a beneficial washing performance, in particular also after storage. Furthermore, they are storage stable at elevated temperature, i.e. they are clear solutions at elevated temperature also after a prolonged time of storage.

The polyesters of component A) of the inventive compositions may advantageously be prepared by a process which comprises heating dimethyl terephthalate (DMT), 1,2-propylene glycol (PG), and X—$(OC_2H_4)_n$—$(OC_3H_6)_m$—OH, wherein X is $C_{1-4}$ alkyl and preferably methyl, the —$(OC_2H_4)$ groups and the —$(OC_3H_6)$ groups are arranged blockwise and the block consisting of the —$(OC_3H_6)$ groups is bound to the hydroxyl group —OH and n and m are as defined for the polyesters of component A) of the inventive compositions, with the addition of a catalyst, to temperatures of from 160 to 220° C., firstly at atmospheric pressure, and then continuing the reaction under reduced pressure at temperatures of from 160 to 240° C.

Reduced pressure preferably means a pressure of from 0.1 to 900 mbar and more preferably a pressure of from 0.5 to 500 mbar.

Preferably, the process for the preparation of the polyesters of component A) of the inventive compositions is characterized in that a) dimethyl therephthalate, 1,2-propylene glycol, X—$(OC_2H_4)_n$—$(OC_3H_6)_m$—OH, wherein X is $C_{1-4}$ alkyl and preferably methyl, and a catalyst are added to a reaction vessel, heated under inert gas, preferably nitrogen, to a temperature of from 160° C. to 220° C. to remove methanol and then pressure is reduced to below atmospheric pressure, preferably to a pressure of from 200 to 900 mbar and more preferably to a pressure of from 400 to 600 mbar for completion of the transesterification, and b) in a second step the reaction is continued at a temperature of from 210° C. to 240° C. and at a pressure of from 0.1 to 10 mbar and preferably of from 0.5 to 5 mbar to form the polyester.

Sodium acetate (NaOAc) and tetraisopropyl orthotitanate (IPT) is preferably used as the catalyst system in the preparation of the polyesters of component A) of the inventive compositions.

The preparation of the polyesters of component A) of the inventive compositions is e.g. described in WO 2013/019658 A1.

Preferably, the one or more alcohols of component B) of the inventive compositions are selected from the group consisting of 1,2-propylene glycol, 1,3-propylene glycol and butyl glycol.

More preferably, the alcohol of component B) of the inventive compositions is 1,2-propylene glycol.

The inventive compositions preferably comprise of from 45 to 55% by weight of the one or more polyesters of component A), of from 15 to 25% by weight of the one or more alcohols of component B), and of from 24 to 40% by weight of water of component C), the amounts in each case being based on the total weight of the inventive composition.

The inventive compositions may preferably comprise of from 0 to 10% by weight, and more preferably of from 0 to 5% by weight, of one or more additives, that may generally be used in detergent applications. Additives that may be used are e.g. sequestering agents, complexing agents, polymers different from the one or more polyesters of component A) of the inventive compositions, and surfactants.

In a preferred embodiment of the invention the inventive compositions preferably comprise one or more additives (component D)), and in this case the amount of water of component C) in the inventive compositions preferably is of from 24 to 39.95% by weight, the amounts in each case being based on the total weight of the inventive compositions.

The one or more additives of component D) of the inventive compositions are preferably selected from the group consisting of sequestering agents, complexing agents, polymers different from the one or more polyesters of component A) and surfactants.

Suitable sequestering agents e.g. are polyacrylic acid or acrylic acid/maleic acid copolymers (e.g. Sokalan® CP 12S, BASF).

Suitable complexing agents e.g. are EDTA (ethylene diamine tetraactetate), diethylene triamine pentaacetate, nitrilotriacetic acid salts or iminodisuccinic acid salts.

Suitable polymers different from the one or more polyesters of component A) of the inventive compositions e.g. are dye transfer inhibitors such as e.g. vinyl pyrrolidone.

Suitable surfactants may be anionic surfactants such as lauryl sulfate, lauryl ether sulfate, alkane sulfonates, linear alkylbenzene sulfonates, methylester sulfonates, amine oxides or betaine surfactants.

Preferably, the one or more additives of component D) are present in the inventive compositions in an amount of up to 10% by weight, and in this case the amount of water of component C) in the inventive compositions preferably is of from 24 to 39.95% by weight, the amounts in each case being based on the total weight of the inventive compositions.

More preferably, the one or more additives of component D) are present in the inventive compositions in an amount of from 0.1 to 10% by weight, and in this case the amount of water of component C) in the inventive compositions preferably is of from 24 to 39.9% by weight, the amounts in each case being based on the total weight of the inventive compositions.

Even more preferably, the one or more additives of component D) are present in the inventive compositions in an amount of from 0.5 to 5% by weight, and in this case the amount of water of component C) in the inventive compositions preferably is of from 24 to 39.5% by weight, the amounts in each case being based on the total weight of the inventive compositions.

In a further preferred embodiment of the invention the inventive compositions consist of the one or more polyesters of component A), the one or more alcohols of component B), and water of component C).

Preferably, the viscosity of the inventive compositions, measured at 25° C., is of from 200 to 5 000 mPa·s.

More preferably, the viscosity of the inventive compositions, measured at 25° C., is of from 500 to 2 000 mPa·s.

The viscosities are measured on the inventive compositions themselves using a Brookfield-viscosimeter, model DV II and the spindles of the set of spindles RV at 20 revolutions per minute and 25° C. Spindle No. 1 is used for viscosities of up to 500 mPa·s, spindle No. 2 for viscosities of up to 1 000 mPa·s, spindle No. 3 for viscosities of up to 5 000 mPa·s, spindle No. 4 for viscosities of up to 10 000 mPa·s, spindle No. 5 for viscosities of up to 20 000 mPa·s, spindle No. 6 for viscosities of up to 50 000 mPa·s and spindle No. 7 for viscosities of up to 200 000 mPa·s.

The examples below are intended to illustrate the invention in detail without, however, limiting it thereto. Unless explicitly stated otherwise, all percentages given are percentages by weight (% by wt. or wt.-%).

General Procedure for the Preparation of the Polyesters of the Examples

The polyester synthesis is carried out by the reaction of dimethyl terephthalate (DMT), 1,2-propylene glycol (PG), and methyl polyalkyleneglycol using sodium acetate (NaOAc) and tetraisopropyl orthotitanate (IPT) as the catalyst system. The synthesis is a two-step procedure. The first step is a transesterification and the second step is a polycondensation.

Transesterification

Dimethyl terephthalate (DMT), 1,2-propylene glycol (PG), methyl polyalkyleneglycol, sodium acetate (anhydrous) (NaOAc) and tetraisopropyl orthotitanate (IPT) are weighed into a reaction vessel at room temperature.

For the melting process and homogenization, the mixture is heated up to 170° C. for 1 h and then up to 210° C. for a further 1 h sparged by a nitrogen stream. During the transesterification methanol is released from the reaction and is distilled out of the system (distillation temperature <55° C.). After 2 h at 210° C. nitrogen is switched off and the pressure is reduced to 400 mbar over 3 h.

Polycondenzation

The mixture is heated up to 230° C. At 230° C. the pressure is reduced to 1 mbar over 160 min. Once the polycondenzation reaction has started, 1,2-propylene glycol is distilled out of the system. The mixture is stirred for 4 h at 230° C. and a pressure of 1 mbar. The reaction mixture is cooled down to 140-150° C. Vacuum is released with nitrogen and the molten polymer is transferred into a glass bottle.

EXAMPLE I

| Amount [g] | Amount [mol] | Raw Material [Abbreviation] |
|---|---|---|
| 101.95 | 0.53 | DMT |
| 84.0 | 1.104 | PG |
| 343.5 | 0.15 | $H_3C—(OC_2H_4)_{45}—(OC_3H_6)_5—OH$ |
| 0.5 | 0.0061 | NaOAc |
| 0.2 | 0.0007 | IPT |

A polyester according to formula (I) is obtained wherein $R^1$ and $R^2$ are $H_3C—(OC_2H_4)_n—(OC_3H_6)_m$ wherein the $—(OC_2H_4)$ groups and the $—(OC_3H_6)$ groups are arranged blockwise and the block consisting of the $—(OC_3H_6)$ groups is bound to a COO group, n is based on a molar average 45, m is based on a molar average 5, and a is based on a molar average a number of from 6 to 7.

EXAMPLE II

| Amount [g] | Amount [mol] | Raw Material [Abbreviation] |
|---|---|---|
| 101.95 | 0.53 | DMT |
| 84.0 | 1.104 | PG |
| 317.4 | 0.15 | $H_3C—(OC_2H_4)_{45}—(OC_3H_6)_2—OH$ |
| 0.5 | 0.0061 | NaOAc |
| 0.2 | 0.0007 | IPT |

A polyester according to formula (I) is obtained wherein $R^1$ and $R^2$ are $H_3C—(OC_2H_4)_n—(OC_3H_6)_m$ wherein the $—(OC_2H_4)$ groups and the $—(OC_3H_6)$ groups are arranged blockwise and the block consisting of the $—(OC_3H_6)$ groups is bound to a COO group, n is based on a molar average 45, m is based on a molar average 2, and a is based on a molar average a number of from 6 to 7.

Stability Tests

Solutions according to the compositions of the following table have been prepared by dissolving the polyester in the respective mixture of water and alcoholic solvent. The additive Sokalan® CP 12S was dissolved in the final mixture. The mixtures were investigated with respect to their stability in a storage cabinet (+=clear solution, o=turbidity, −=pronounced turbidity/precipitation). Freshly prepared samples are clear solutions.

The polyester of Example I (Ex. I) has been used for the stability tests.

Sokalan® CP 12S (acrylic acid/maleic acid copolymer, BASF) has been used as the additive.

From the table it can be seen that solutions of the soil release polyesters in water (Examples 1-4) become turbid at 45° C. already after two weeks of storage. Inventive compositions comprising 1,2-propylene glycol or butyl glycol are still clear after 4 weeks of storage at 45° C.

| Example | Polyester of Ex. I [wt.-%] | Water [wt.-%] | 1,2-Propylene glycol [wt.-%] | Butyl glycol [wt.-%] | Glycerol [wt.-%] | Additive [wt.-%] | clarity at 45° C. after 2 weeks | clarity at 45° C. after 4 weeks | Viscosity at 25° C. [mPa · s] |
|---|---|---|---|---|---|---|---|---|---|
| 1 | 35 | 65 | | | | | – | – | 250 |
| 2 | 35 | 64 | | | | 1 | – | – | 260 |
| 3 | 40 | 60 | | | | | – | – | 850 |
| 4 | 50 | 50 | | | | | – | – | 3300 |
| 5 | 45 | 44 | 10 | | | 1 | – | – | |
| 6 | 45 | 39 | 15 | | | 1 | + | + | |
| 7 | 45 | 34 | 20 | | | 1 | + | + | |
| 8 | 45 | 24 | 30 | | | 1 | + | + | |
| 9 | 45 | 44 | | 10 | | 1 | – | – | |
| 10 | 45 | 39 | | 15 | | 1 | + | + | |
| 11 | 45 | 34 | | 20 | | 1 | + | + | |
| 12 | 50 | 40 | 10 | | | | + | + | |
| 13 | 50 | 40 | | 10 | | | + | + | |
| 14 | 50 | 39 | 10 | | | 1 | + | + | |
| 15 | 50 | 39 | | 10 | | 1 | + | + | |
| 16 | 55 | 34 | 10 | | | | + | ○ | |
| 17 | 55 | 34 | | 10 | | | + | + | |
| 18 | 50 | 30 | 20 | | | | + | + | 1170 |
| 19 | 50 | 35 | 15 | | | | + | + | 1260 |
| 20 | 50 | 29 | 20 | | | 1 | + | + | 1170 |
| 21 | 50 | 25 | 25 | | | | + | + | 870 |
| 22 | 50 | 30 | | 20 | | | + | ○ | 285 |
| 23 | 40 | 50 | | | 10 | | – | – | |
| 24 | 45 | 45 | | | 10 | | – | – | |
| 25 | 40 | 49 | | | 10 | 1 | – | – | |
| 26 | 45 | 44 | | | 10 | 1 | – | – | |
| 27 | 50 | 30 | | | 20 | | – | – | |
| 28 | 50 | 30 | | | 20 | | – | – | |

The invention claimed is:

1. A composition comprising

A) 45 to 55% by weight of at least one polyester according to the following formula (I)

(I)

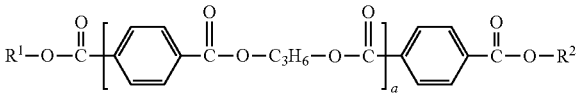

wherein $R^1$ and $R^2$ independently of one another are X—$(OC_2H_4)_n$—$(OC_3H_6)_m$ wherein X is $C_{1-4}$ alkyl, the —$(OC_2H_4)$ group and the —$(OC_3H_6)$ group are arranged blockwise and the block consisting of the —$(OC_3H_6)$ group is bound to a COO group or are HO—$(C_3H_6)$, n is based on a molar average and is a number of from 12 to 120, m is based on a molar average and is a number of from 1 to 10, and a is based on a molar average and is a number of from 4 to 9 and B) 10 to 30% by weight of at least one alcohol selected from the group consisting of ethylene glycol, 1,2-propylene glycol, 1,3-propylene glycol, 1,2-butylene glycol, 1,3-butylene glycol, 1,4-butylene glycol and butyl glycol, and C) 24 to 42% by weight of water, the amounts in each case being based on the total weight of the composition.

2. The composition according to claim 1, wherein in the at least one polyester of component A) according to formula (I)

$R^1$ and $R^2$ independently of one another are $H_3C$—$(OC_2H_4)_n$—$(OC_3H_6)_m$ wherein the —$(OC_2H_4)$ group and the —$(OC_3H_6)$ group are arranged blockwise and the block consisting of the —$(OC_3H_6)$ group is bound to a COO group or are HO—$(C_3H_6)$, n is based on a molar average and is a number of from 40 to 50, m is based on a molar average and is a number of from 1 to 7, and a is based on a molar average and is a number of from 4 to 9.

3. The composition according to claim 1, wherein in the at least one polyester of component A) according to formula (I), a is based on a molar average and is a number of from 5 to 8.

4. The composition according to claim 3, wherein in the at least one polyester of component A) according to formula (I), a is based on a molar average and is a number of from 6 to 7.

5. The composition according to claim 1, wherein in the at least one polyester of component A) according to formula (I), m is based on a molar average and is a number of from 2 to 5.

6. The composition according to claim 1, wherein in the at least one polyester of component A) according to formula (I), n is based on a molar average and is a number of from 43 to 47.

7. The composition according to claim 6, wherein in the at least one polyester of component A) according to formula (I), n is based on a molar average and is a number of from 44 to 46.

8. The composition according to claim 7, wherein in the at least one polyester of component A) according to formula (I), n based on a molar average is 45.

9. The composition according to claim 1, wherein in the at least one polyester of component A) according to formula (I), $R^1$ and $R^2$ independently of one another are $H_3C$—$(OC_2H_4)_n$—$(OC_3H_6)_m$ wherein the —$(OC_2H_4)$ group and the —$(OC_3H_6)$ group are arranged blockwise and the block consisting of the —$(OC_3H_6)$ group is bound to a COO group, n is based on a molar average and is a number of from 44 to 46, m is based on a molar average and is 2, and a is based on a molar average and is a number of from 5 to 8.

10. The composition according to claim 9, wherein in the at least one polyester of component A) according to formula (I), n is based on a molar average and is 45, and a is based on a molar average and is a number of from 6 to 7.

11. The composition according to claim 1, wherein in the at least one polyester of component A) according to formula (I), $R^1$ and $R^2$ independently of one another are $H_3C$—$(OC_2H_4)_n$—$(OC_3H_6)_m$ wherein the —$(OC_2H_4)$ group and the —$(OC_3H_6)$ group are arranged blockwise and the block consisting of the —$(OC_3H_6)$ group is bound to a COO group, n is based on a molar average and is a number of from 44 to 46, m is based on a molar average and is 5, and a is based on a molar average and is a number of from 5 to 8.

12. The composition according to claim 11, wherein in the at least one polyester of component A) according to formula (I) n is based on a molar average and is 45, and a is based on a molar average and is a number of from 6 to 7.

13. The composition according to claim 1, wherein in the at least one alcohol of component B) is selected from the group consisting of 1,2-propylene glycol, 1,3-propylene glycol and butyl glycol.

14. The composition according to claim 13, wherein the alcohol of component B) is 1,2-propylene glycol.

15. The composition according to claim 1, comprising from 45 to 55% by weight of the at least one polyester of component A), from 15 to 25% by weight of the at least one alcohol of component B), and from 24 to 40% by weight of water of component C), the amounts in each case being based on the total weight of the composition.

16. The composition according to claim 1, further comprising at least one additive (component D).

17. The composition according to claim 16, wherein the at least one additive of component D) is selected from the group consisting of sequestering agents, complexing agents, polymers different from the at least one polyester of component A) and surfactants.

18. The composition according to claim 16, wherein the at least one additive of component D) is present in the composition in an amount of up to 10% by weight based on the total weight of the composition.

19. The composition according to claim 16, wherein the at least one additive of component D) is present in the composition in an amount of from 0.1 to 10% by weight being based on the total weight of the composition.

20. The composition according to claim 16, wherein the at least one additive of component D) is present in the composition in an amount of from 0.5 to 5% by weight based on the total weight of the composition.

21. The composition according to claim 1, consisting of the at least one polyester of component A), the at least one alcohol of component B), and water of component C).

22. The composition according to claim 1, wherein the viscosity of the composition, measured at 25° C., is of from 200 to 5 000 mPa·s.

23. The composition according to claim 22, wherein the viscosity of the composition, measured at 25° C., is of from 500 to 2 000 mPa·s.

* * * * *